US005503231A

United States Patent [19]

Palmatier

[11] Patent Number: 5,503,231

[45] Date of Patent: Apr. 2, 1996

[54] CHIMNEY FIRE SAFETY SYSTEM

[76] Inventor: Jon Palmatier, Box 371-2, Brotzman Rd., Binghamton, N.Y. 13901

[21] Appl. No.: 192,662

[22] Filed: Feb. 7, 1994

[51] Int. Cl.[6] ..... A62C 3/04

[52] U.S. Cl. ..... 169/54; 169/57

[58] Field of Search ..... 169/54, 46, 57, 169/58, 42, 26

[56] References Cited

U.S. PATENT DOCUMENTS

| | | | |
|---|---|---|---|
| 1,100,837 | 6/1914 | Lorimer | 169/26 |
| 2,011,803 | 8/1935 | Dube | 169/54 |
| 2,177,963 | 10/1939 | Stover | 169/26 |
| 2,786,537 | 3/1957 | Wainess | 169/57 |
| 2,876,845 | 3/1959 | Boyce | 169/57 |
| 3,907,037 | 9/1975 | Linsalato et al. | 169/26 |
| 4,260,023 | 4/1981 | Irmscher | 169/42 |
| 4,384,617 | 5/1983 | Mueller | 169/57 |
| 4,469,183 | 9/1984 | Hayes | 169/57 |
| 4,664,198 | 5/1987 | Johnson | 169/38 |
| 4,947,736 | 8/1990 | Koning | 169/57 |
| 5,163,516 | 11/1992 | Palmatier | 169/54 |

*Primary Examiner*—David M. Mitchell
*Assistant Examiner*—Gary C. Hoge
*Attorney, Agent, or Firm*—Salzman & Levy

[57] ABSTRACT

The present invention features an improved chimney fire safety device. The device includes a cylindrical canister that is affixed in the top of a chimney or stove pipe. The canister contains one or more membranes containing extinguishing compounds. A metal dish is disposed in the bottom of the canister, and holds the extinguishing compounds in place until needed. The walls of the canister adjacent the metal dish are coated with a frictionless, high-temperature, anti-seize material, so that the metal dish will drop from the canister without difficulty at the proper time. A fuse cap is affixed to the bottom of the canister. The fuse cap is contiguously held to the metal dish, and keeps it in place until a predetermined temperature of an uncontrolled fire is reached. Thereafter, the fuse cap will disintegrate and allow the metal dish to drop from the canister. The metal dish will not leak extinguisher chemicals, because the heat conductive nature of the metal dish will distribute the heat across the contiguous fuse cap surface, and prevent hot spots from developing in the fuse cap.

13 Claims, 2 Drawing Sheets

CHIMNEY FIRE SAFETY SYSTEM

FIELD OF THE INVENTION

The invention relates to chimney fire safety devices and more particularly to a trigger mechanism for a chimney safety system that automatically extinguishes a chimney fire or runaway wood burning stove fire that is out of control.

RELATED PATENT APPLICATIONS

This application presents an improvement in the safety system disclosed in U.S. Pat. No. 5,163,516, by the same inventor, issued Nov. 17, 1992.

BACKGROUND OF THE INVENTION

The aforementioned U.S. Pat. No. 5,163,516 describes a fire fighting system for a chimney or wood burning stove fire that is out of control. The fire fighting system dumps chemical fire extinguishing materials upon an out-of-control chimney fire in sequential or multistage increments.

In theory, such dumping is a more efficient means of bringing these raging fires under control than is bulk application of the chemicals. The various compounds of the extinguisher of the aforementioned patent are encased and nested in a fusible, time-release membrane. The staged release of the chemicals incrementally brings the fire under control.

In practice, however, the staging of the extinguisher chemicals is not always uniformly accomplished. It has been discovered that the fusible membranes housing the chemicals may often rupture due to the formation of hot spots and consequential partial burn-through that occur in the fuse cap. When this happens, the chemicals will gradually leak out of their membranes over time, causing the fire-fighting system to become ineffective.

It would be advantageous to provide an improved combination of fuse cap and charge-containing members that prevents the formation of hot spots in the fuse cap. The possibility of chemical leakage would therefore be greatly reduced, thus maintaining the integrity of the chemical storage system.

SUMMARY OF THE INVENTION

In accordance with the present invention, there is provided an improved chimney fire safety device. The device includes a cylindrical canister that is affixed in the top of a chimney or stove pipe. The canister contains one or more membranes containing extinguishing compounds. A metal dish is disposed in the bottom of the canister, and holds the extinguishing compounds in place until needed. The walls of the canister adjacent the metal dish are coated with a frictionless, high-temperature, anti-seize material, so that the metal dish will drop from the canister without difficulty at the proper time. A fuse cap is affixed to the bottom of the canister. The fuse cap is contiguously held to the metal dish, and keeps it in place until a predetermined temperature of an uncontrolled fire is reached. Thereafter, the fuse cap will disintegrate and allow the metal dish to drop from the canister. The metal dish will not leak extinguisher chemicals, because the heat conductive nature of the metal dish will distribute the heat across the contiguous fuse cap surface, and prevent hot spots from developing in the fuse cap. The fuse cap is held in place by a ring clamp that girdles the bottom of the canister cylinder. The ring clamp is used, not only to retain the fuse cap, but, more importantly, to concentrate heat around the periphery of the fuse cap in order to ensure complete separation thereof and discharge of the chemical compounds. A high temperature sealant, such as silicone, is disposed between the fuse cap and the outer wall of the canister, thus creating a weather-tight and chemical seal for the extinguisher compounds.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a fire safety device for chimney or wood burning stove fires. A dangerous or runaway fire in a chimney or wood burning stove flue is treated by extinguisher compounds contained in one or more membranes disposed within a canister. The canister is disposed in an upper portion of a chimney or stove pipe. The membranes containing the fire extinguishing compounds are held within the canister by a metal dish contiguously affixed to a fuse cap disposed in the bottom of the canister. Heat from a runaway or uncontrolled fire will cause the fuse cap to separate completely at the periphery of the canister, thus releasing the fire-fighting extinguisher compounds in one discharge, rather than in a continuous, low-volume leak. The metal dish prevents hot spots from developing in the fuse cap by reason of its heat conductivity, thus preventing chemical leakage before the chemicals are needed. The chemical extinguisher compounds are used to douse a dangerous fire at the proper time, thus ensuring that the fire will be brought under control.

For the purposes of brevity, like elements and components will have the same designation throughout the figures.

Figure 1:
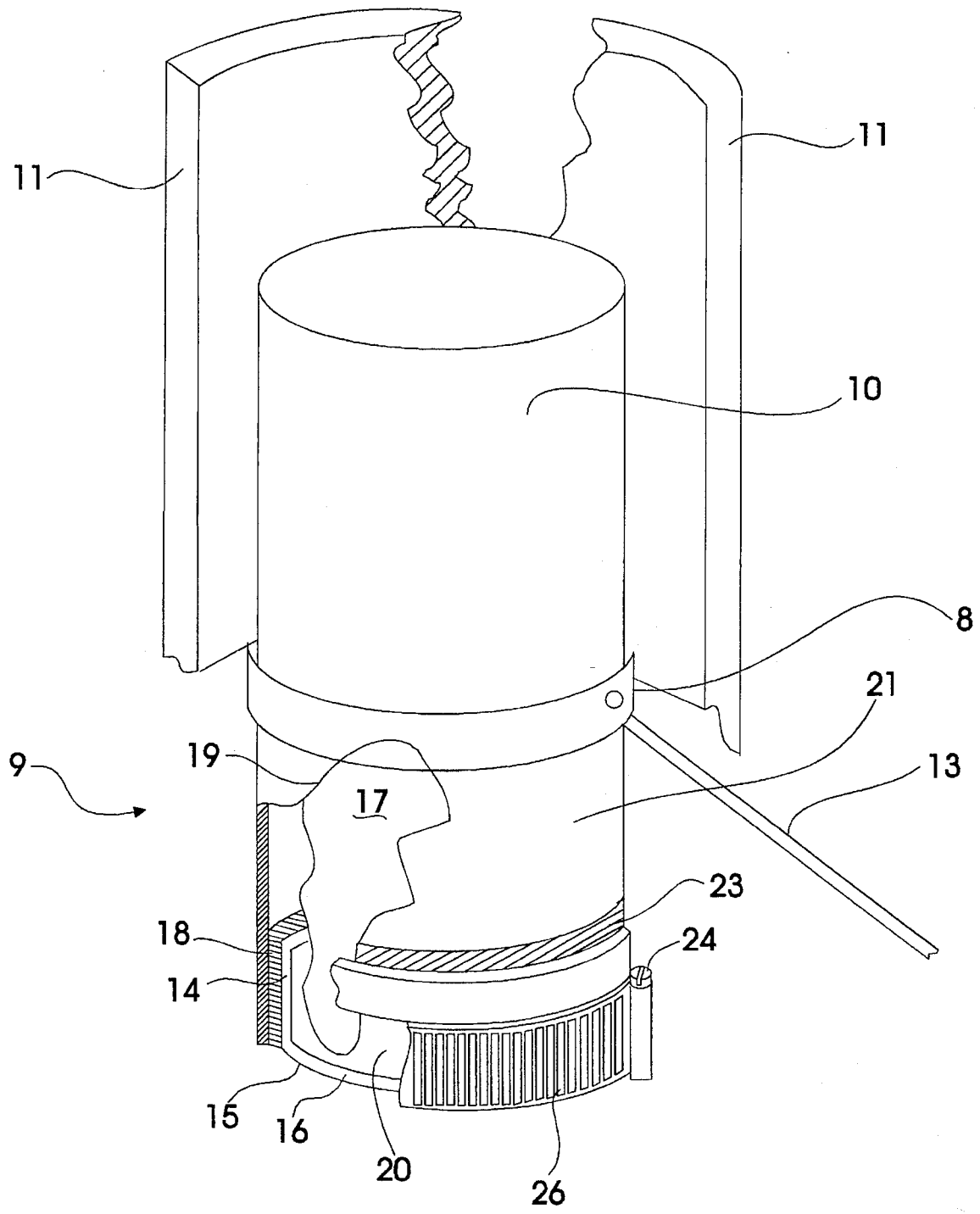
FIG. 1 is a schematic, cut-away, perspective view of the fire safety device of the invention.
Figure 2:
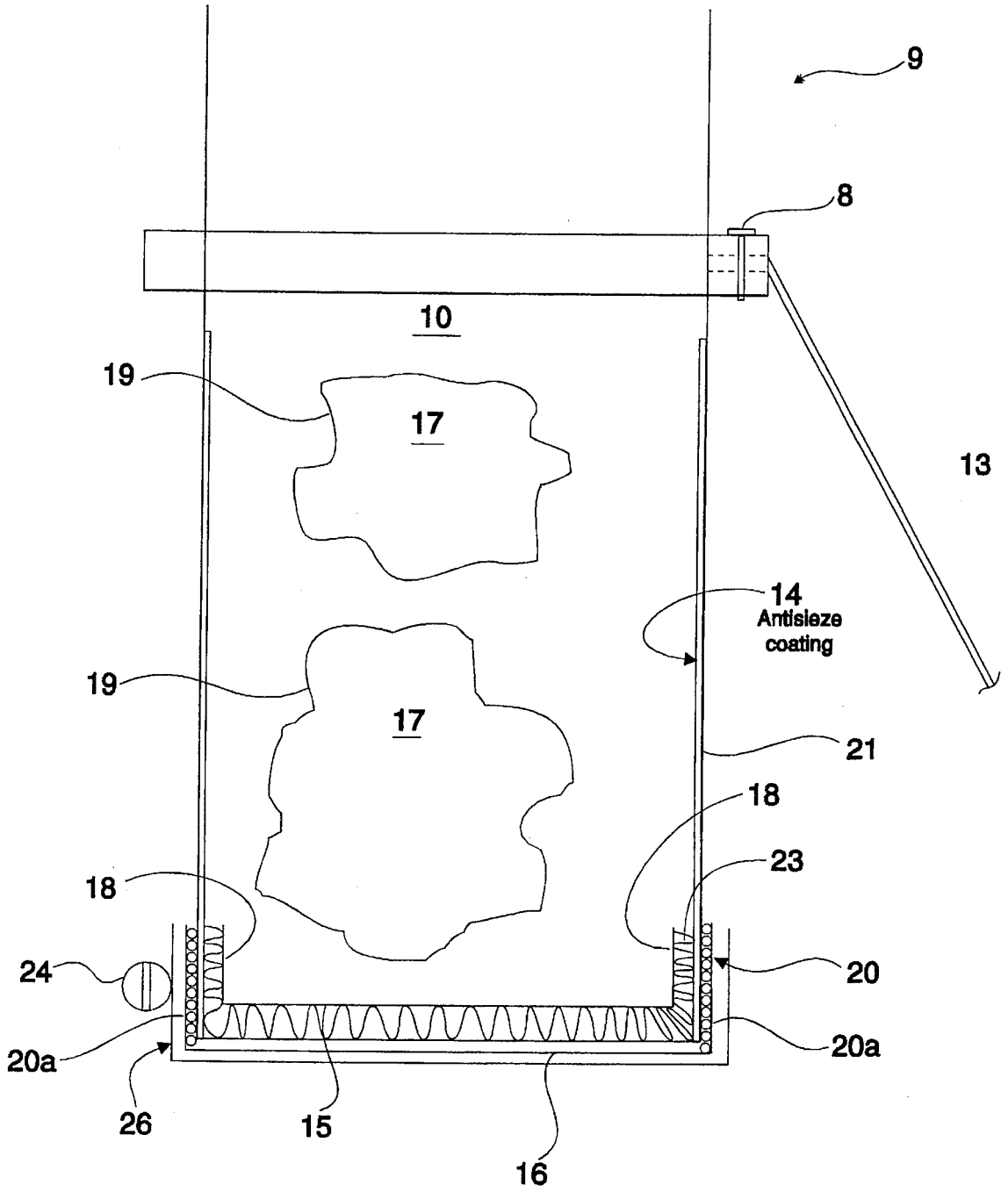
FIG. 2 is a schematic, sectional view of the fire safety device of FIG. 1.

Now referring to FIGS. 1 and 2, the fire safety device 9 of this invention is shown. The device 9 comprises a housing in the form of a cylindrical canister 10 that is affixed above a chimney or flue 11 by suitable fixturing, such as mounting legs 13 connected to an adjustable circular mounting ring 8, which can be moved along the length of canister 10 to allow the setting of preferred temperature release. The canister 10 contains a mass of fire extinguisher compounds 17 disposed within one or more membrane envelopes 19, as fully described in the aforementioned U.S. Pat. No. 5,163,516. It should be understood, however, that, without departing from the scope of this invention, envelopes 19 can be eliminated and bulk chemicals used.

Each membrane 19 disposed in canister 10 can be designed to release its contained substances at a different time, so that a steady, progressive, sequential stream of chemicals is fed to the fire. In this manner, each of the chemicals begins operation where the previous chemical left off, extinguishing the fire in a progressive manner, as described in the aforementioned United States patent.

The membrane envelopes 19 rest within a dish 18 disposed in a bottom portion of the canister 10. The dish 18 is fabricated of metal of high thermal conductivity, such as aluminum. The bottom portion 15 of the metal dish 18 is contiguous with a fuse cap 20, which can be made of high temperature plastic, that is in contact with the chimney flue gases, not shown. The fuse cap 20 is designed to melt or disintegrate at temperatures consistent with fires that are out-of-control (i.e., at temperatures greater than approximately 850° F. at flue exit or approximately 1,000° F. in the firebox). The metal dish 18 will drop from the canister 10 upon disintegration of the fuse cap 20, thus releasing the membrane envelopes 19 into the fire.

The bottom 15 of the metal dish 18, being in contiguous contact with the fuse cap 20, distributes the heat uniformly across the bottom 16 of the fuse cap 20, by virtue of its high thermal conductivity. In this fashion, the metal dish 18 prevents the development of hot spots in the fuse cap 20. The uniform heating of the bottom 16 of fuse cap 20 ensures that the fuse cap 20 will not partially deteriorate before an emergency situation is reached. Therefore, the extinguisher compounds 17 will be fed to the fire only when an emergency condition generates suitably high temperatures.

As aforementioned, the metal dish 18 is caused to drop out of the canister 10 by virtue of the releasing of the fuse cap 20. The fuse cap 20 is affixed to the outer wall 21 of canister 10 by means of a sealant 23 comprising high temperature silicone. Sealant 23 is coated between the canister wall 21 and the fuse cap 20 and also between metal dish 18 and fuse cap 20 to prevent moisture from entering the canister 10 and to prevent seepage of chemical materials 17.

A stainless steel, thermal-distributing clamp ring 26 is installed and mounted by means of a clamp set screw 24 for heat distribution purposes. Clamp ring 26 extends approximately 1/16" to 1/8" below the bottom 16 of fuse cap 20. Heat is therefore forced to concentrate at the periphery **20*a* of the fuse cap 20**.

An anti-seize compound 14 (operable up to approximately 2,200° F.) prevents the metal dish 18 and envelopes 19 from adhering to the cylinder inner wall 21.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the current invention, what is desired to be protected by Letters Patent is presented by the subsequently appended claims.

What is claimed is:

1. A chimney fire safety device for attacking a chimney or stove pipe fire that is in a dangerous or runaway fire condition by application of flame extinguishing compounds, comprising:

a) a housing having a bottom portion that is in contact with flue gases, said housing being mountable within a chimney or stove pipe flue, and containing fire extinguishing compounds, said housing further comprising an inner and an outer wall, said inner wall being coated with frictionless material;

b) a mass of extinguishing compounds disposed within said housing;

c) fusing means disposed in said bottom portion of said housing, and operative to disintegrate when said flue gases reach a temperature commensurate with a dangerous or runaway fire condition, said fusing means causing release of said extinguishing compounds upon said dangerous or runaway fire; and d) support means disposed in said bottom portion of said housing and disposed substantially contiguously with said fusing means, said support means having a thermal conductivity sufficient to prevent hot spots from forming in said fusing means to prevent leakage of said mass of fire extinguishing compounds from said housing prior to said dangerous or runaway fire condition, said support means for carrying said mass of extinguishing compounds until said fusing means disintegrates, said support means being in contact with said frictionless material coated upon said inner wall of said housing, whereby said support means is free to drop from said housing upon disintegration of said fusing means, and further whereby when said support means drops from said housing, said extinguishing compounds are released into said dangerous or runaway fire in order to establish control thereof.

2. The chimney fire safety device in accordance with claim 1, further comprising at least one envelope for encasing said mass of extinguishing compounds.

3. The chimney fire safety device in accordance with claim 1, wherein said support means comprises a metal dish.

4. The chimney fire safety device in accordance with claim 1, wherein said housing comprises a cylindrical canister.

5. The chimney fire safety device in accordance with claim 1, wherein said fusing means is sealed to walls of said housing.

6. A chimney fire safety device for attacking a chimney or stove pipe fire that is in a dangerous or runaway fire condition by application of flame extinguishing compounds, comprising:

a) a canister having a bottom portion that is in contact with flue gases, said housing being mountable within a chimney or stove pipe flue, and containing fire extinguishing compounds, said canister comprising an inner and an outer wall, said inner wall being coated with frictionless material;

b) a mass of extinguishing compounds disposed within said canister;

c) fusing means disposed in said bottom portion of said canister, and operative to disintegrate when said flue gases reach a temperature commensurate with a dangerous or runaway fire condition, said fusing means causing release of said extinguishing compounds upon said dangerous or runaway fire; and d) support means disposed in said bottom portion of said canister and disposed substantially contiguously with said fusing means, said support means having a thermal conductivity sufficient to prevent hot spots from forming in said fusing means to prevent leakage of said mass of fire extinguishing compounds from said canister prior to said dangerous or runaway fire condition, said support means for carrying said mass of extinguishing compounds until said fusing means disintegrates, said support means being in contact with said frictionless material, whereby said support means is free to drop from said canister upon disintegration of said fusing means, releasing said compounds into said dangerous or runaway fire in order to establish control thereof.

7. The chimney fire safety device in accordance with claim 6, further comprising at least one envelope for encasing said mass of extinguishing compounds.

8. The chimney fire safety device in accordance with claim 6, wherein said support means comprises a metal dish.

9. The chimney fire safety device in accordance with claim 6, wherein said fusing means is sealed to walls of said canister.

10. A chimney fire safety device for attacking a chimney or stove pipe fire that is in a dangerous or runaway fire condition by application of flame extinguishing compounds thereupon, comprising:

a) a canister having a bottom portion that is in contact with flue gases, said housing being mountable within a chimney or stove pipe flue, and containing fire extinguishing compounds, said canister having an inner and an outer wall, said inner wall being coated with frictionless material;

b) a mass of extinguishing compounds disposed within said canister;

c) fusing means disposed in said bottom portion of said canister, and operative to disintegrate when said flue gases reach a temperature commensurate with a dangerous or runaway fire condition, said fusing means causing release of said extinguishing compounds upon said dangerous or runaway fire; and d) a dish disposed in said bottom portion of said canister and disposed substantially contiguously with said fusing means, said dish having a thermal conductivity sufficient to prevent hot spots from forming in said fusing means to prevent leakage of said mass of fire extinguishing compounds from said canister prior to said dangerous or runaway fire condition, said dish for carrying said mass of extinguishing compounds until said fusing means disintegrates, said dish being in contact with said frictionless material coated upon said inner wall of said canister, whereby said dish is free to drop from said canister upon disintegration of said fusing means, causing said extinguishing compounds to be released into said dangerous or runaway fire in order to bring said dangerous or runaway fire under control.

11. The chimney fire safety device in accordance with claim 10, further comprising at least one envelope for encasing said mass of extinguishing compounds.

12. The chimney fire safety device in accordance with claim 10, wherein said dish comprises metal.

13. The chimney fire safety device in accordance with claim 10, wherein said fusing means is sealed to walls of said canister.

* * * * *